US008210157B2

(12) United States Patent
Sohn et al.

(10) Patent No.: US 8,210,157 B2
(45) Date of Patent: Jul. 3, 2012

(54) EXHAUST GAS RECIRCULATION SYSTEM WITH UNIFIED CYLINDER HEAD AND EXHAUST GAS RECIRCULATION DEVICE

(75) Inventors: Youngmin Sohn, Hwaseong (KR); Woo Tae Kim, Suwon (KR); Chun Woo Lee, Hwaseong (KR)

(73) Assignee: Hyundai Motor Company, Seoul (KR)

( * ) Notice: Subject to any disclaimer, the term of this patent is extended or adjusted under 35 U.S.C. 154(b) by 289 days.

(21) Appl. No.: 12/565,188

(22) Filed: Sep. 23, 2009

(65) Prior Publication Data

US 2010/0139632 A1 Jun. 10, 2010

(30) Foreign Application Priority Data

Dec. 5, 2008 (KR) ..... 10-2008-0123538

(51) Int. Cl.
*F02B 47/08* (2006.01)
*F02M 25/07* (2006.01)

(52) U.S. Cl. ..... 123/568.13; 123/568.11; 123/568.17; 123/568.18

(58) Field of Classification Search ..... 123/568.11, 123/568.17, 568.18, 568.13
See application file for complete search history.

(56) References Cited

U.S. PATENT DOCUMENTS

| | | | | |
|---|---|---|---|---|
| 3,820,514 | A * | 6/1974 | Kuehl | 123/568.18 |
| 6,142,116 | A * | 11/2000 | Freese | 123/193.3 |
| 6,164,269 | A * | 12/2000 | Feucht et al. | 123/568.11 |
| 6,213,074 | B1 * | 4/2001 | Freese | 123/90.38 |
| 6,431,128 | B1 * | 8/2002 | Dabadie | 123/58.8 |
| 6,478,017 | B2 * | 11/2002 | Bianchi | 123/568.12 |
| 6,513,506 | B1 * | 2/2003 | Ito et al. | 123/568.13 |
| 6,571,782 | B2 * | 6/2003 | Brosseau et al. | 123/568.18 |
| 6,604,506 | B2 * | 8/2003 | Tanaka et al. | 123/336 |
| 6,752,133 | B2 * | 6/2004 | Arnell | 123/568.12 |
| 6,895,948 | B2 * | 5/2005 | Mori et al. | 123/568.17 |
| 7,011,082 | B2 * | 3/2006 | Husges | 123/568.17 |
| 7,032,579 | B2 * | 4/2006 | Nishida et al. | 123/568.17 |
| 7,353,783 | B2 * | 4/2008 | Nishimura et al. | 123/41.82 R |
| 7,467,624 | B2 * | 12/2008 | An | 123/568.13 |
| 7,556,027 | B2 * | 7/2009 | Duret | 123/568.13 |
| 8,020,539 | B2 * | 9/2011 | Maunoury | 123/568.18 |
| 2006/0283429 | A1 * | 12/2006 | Kuhnel et al. | 123/568.18 |
| 2009/0173320 | A1 * | 7/2009 | Maunoury | 123/568.18 |
| 2010/0154759 | A1 * | 6/2010 | Taira | 123/568.17 |

FOREIGN PATENT DOCUMENTS

| | | |
|---|---|---|
| JP | 2002-106420 A | 4/2002 |
| KR | 1994-0003535 B1 | 4/1994 |

* cited by examiner

*Primary Examiner* — Stephen K Cronin
*Assistant Examiner* — Raza Najmuddin
(74) *Attorney, Agent, or Firm* — Morgan, Lewis & Bockius LLP

(57) ABSTRACT

An exhaust gas recirculation system of an internal combustion engine where a cylinder head having an intake port and an exhaust port is coupled to a cylinder block, and a portion of an exhaust gas exhausted from the exhaust port is flowed into the intake port through a control valve, may include a recirculation gas gallery integrally formed at the cylinder head and communicated with the intake port, a control valve assembly including the control valve and communicated with the recirculation gas gallery, and at least a recirculation gas extracting unit that is communicated with the control valve assembly and the exhaust port.

7 Claims, 2 Drawing Sheets

EXHAUST GAS RECIRCULATION SYSTEM WITH UNIFIED CYLINDER HEAD AND EXHAUST GAS RECIRCULATION DEVICE

CROSS-REFERENCE TO RELATED APPLICATION

The present application claims priority to Korean Patent Application No. 10-2008-0123538 filed on Dec. 5, 2008, the entire contents of which are incorporated herein for all purposes by this reference.

BACKGROUND OF THE INVENTION

1. Field of the Invention

The present invention relates to an exhaust gas recirculation system, and more particularly to an exhaust gas recirculation system with a unified cylinder head and exhaust gas recirculation device.

2. Description of Related Art

Recently, a method that recirculates a portion of exhaust gas to an intake passage in order to reduce NOx of the exhaust gas has been proposed.

Particularly, an exhaust gas recirculation system provided with an exhaust gas recirculation valve (hereinafter called an EGR valve) disposed at one side of an intake manifold disposed between two cylinder banks is well known.

The exhaust gas recirculation system indicates such a method that the recirculation gas is flowed into each inflow ports from passages formed at the intake manifolds through the intake passage therein, or a recirculation gas is flowed into the intake port from the exhaust gas port to the intake port in a long distance.

Performance of an internal combustion engine of a lean combustion type depends on responsiveness of the exhaust gas recirculation.

However, due to the long distance between the exhaust port and the intake port, the responsiveness thereof needs to be improved.

Meanwhile, a material or layout for it is limited because a passage should be considered so that it can guide the exhaust gas to the intake manifold.

Further, a pipe for guiding the exhaust gas from the cylinder head to the intake manifold should be assembled separately, and so the number of parts is increased, and it also requires a space for assembling the pipe.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an exhaust gas recirculation system having advantages of reducing manufacturing cost and a space for mounting thereon through which overall parts excluding a control valve assembly provided for recirculating the exhaust gas are integrally formed with the cylinder head, and thereby the layout can be simplified.

In an aspect of the present invention, the exhaust gas recirculation system of an internal combustion engine where a cylinder head having an intake port and an exhaust port is coupled to a cylinder block, and a portion of an exhaust gas exhausted from the exhaust port is flowed into the intake port through a control valve, may include a recirculation gas gallery integrally formed at the cylinder head and communicated with the intake port, a control valve assembly including the control valve and communicated with the recirculation gas gallery, and at least a recirculation gas extracting unit that is communicated with the control valve assembly and the exhaust port.

The at least a recirculation gas extracting unit may be integrally formed in the cylinder head.

The control valve assembly may be integrally formed in the cylinder head.

The at least a recirculation gas extracting unit may be configured to communicate with the exhaust port.

In another aspect of the present invention, the control valve assembly may include an inflow pipe formed such that the portion of the exhaust gas can be flowed into the control valve therethrough, and a supplying pipe provided with one end communicated with the control valve and the other end thereof communicated with the recirculation gas gallery, wherein the control valve controls an amount of the portion of the exhaust gas so as to supply the amount of the exhaust gas to the recirculation gas gallery, wherein the inflow pipe is connected to one of the at least a recirculation gas extracting unit which is disposed closest to the control valve assembly.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
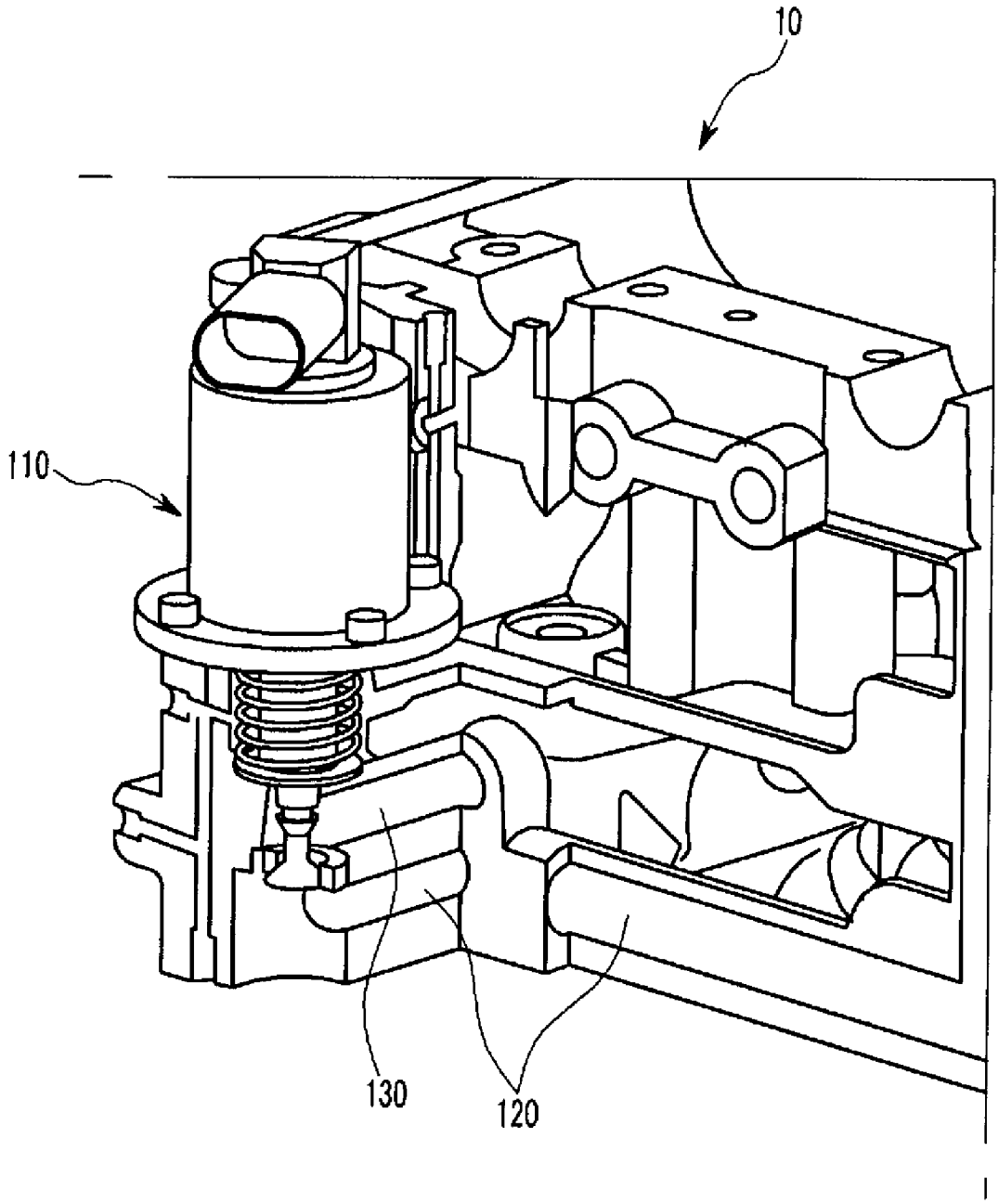
FIG. 1 is a perspective view of a main portion of an exhaust gas recirculation system with a unified cylinder head and exhaust gas recirculation device according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A schematic structure according to an exhaust gas recirculation system with a unified cylinder head and an exhaust recirculation device with reference to the present invention will be described as follows.

As an example, an internal combustion engine may be a flat-four type including four cylinders.

A gasket is interposed between an abutment of the cylinder block and the cylinder head.

That is, the cylinder block and cylinder head are assembled by a plurality of bolts with the gasket interposed therebetween.

A groove is formed between the lower surface of the cylinder head, and a piston head is slidably disposed at each cylinder of the cylinder block so as to define a combustion chamber.

Further, an intake port is formed at one side of the cylinder head in a width direction corresponding to each cylinder, and an exhaust port is formed at the other side of the cylinder head in a width direction corresponding to each the cylinder. Each exhaust port is respectively communicated with an opened intake valve hole disposed at the groove of the upper surface of the combustion chamber, and each exhaust port is communicated with an opened exhaust valve hole at the groove.

Also, an ignition plug inserting hole is provided to the cylinder head for mounting an ignition plug therein.

The intake valve selectively opening/closing the intake valve hole is pressurized by a valve spring toward a direction in which the intake valve is closed and is supported on the cylinder head, and the exhaust valve selectively opening/closing the exhaust valve hole is pressurized by a valve spring toward a direction in which the exhaust valve is closed and is supported on the cylinder head.

Also, a conventional valve drive device including a camshaft and a rocker arm is respectively connected to an upper end of the intake valve or the exhaust valve.

Figure 2:
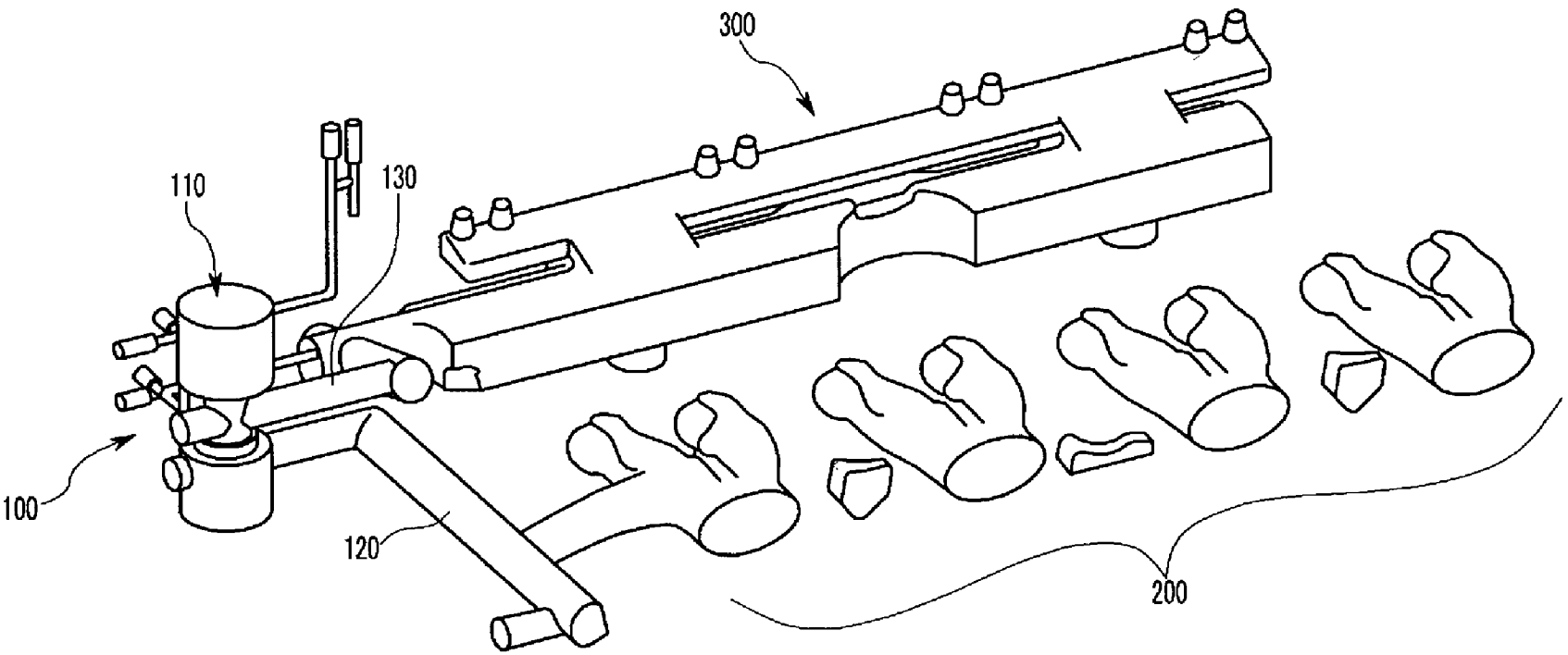
FIG. 2 is a partial perspective view showing an exhaust gas recirculation system with a unified cylinder head and exhaust gas recirculation device applied thereto according to an exemplary embodiment of the present invention.

FIG. 1 is a perspective view of a main portion of an exhaust gas recirculation system with a unified cylinder head and exhaust gas recirculation device according to an exemplary embodiment of the present invention, and FIG. 2 is a partial perspective view showing a state in which an exhaust gas recirculation system with a unified cylinder head and exhaust gas recirculation device is applied thereto according to an exemplary embodiment of the present invention.

Referring to FIG. 1 and FIG. 2, a recirculation gas extracting unit 200 communicating with an exhaust port is provided such that a portion of the exhaust gas exhausted from the exhaust port of each cylinder can be recirculated to each intake port through a control valve 110.

Herein, a plurality of recirculation gas extracting units 200 are integrally formed inside a cylinder head 10 in parallel.

The recirculation gas extracting units 200 are communicated with each other, and an inflow pipe 120 is branched from one recirculation gas extracting unit 200. The recirculation gas unit 200 connected to the inflow pipe 120 may be the closest one to the control valve assembly 100.

That is, the inflow pipe 120 is formed so that it can be communicated with the control valve assembly 100.

Herein, the exhaust gas passes through the inflow pipe 120, and then it arrives at the control valve 110.

The control valve 110 may be provided with a pintle for adjusting a cross-section of the passage and a spring for elastically supporting the pintle.

That is, the control valve 110 controls an amount of recirculation gas supplied to the intake port.

At this time, the control valve 110 is well known to those skilled in the art, and therefore a detailed description thereof will be omitted.

Meanwhile, a supplying pipe 130 is communicated with one end of the control valve 110 for supplying the recirculation gas, and the other end thereof is communicated with a recirculation gas gallery 300.

The recirculation gas gallery 300 is integrally formed inside the cylinder head.

In addition, a space for temporarily storing the recirculation gas supplied from the control valve 110 before it is supplied to the interior of each cylinder, and an inflow hole is formed at a side of the recirculation gas gallery 300 so as to be communicated with the intake port of each cylinder.

In a result, the manufacturing cost and space for mounting thereon are reduced by overall parts excluding the control valve assembly provided for recirculating the exhaust gas being integrally formed with the cylinder head, and thereby the layout can be simplified.

For convenience in explanation and accurate definition in the appended claims, the term "lower" is used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings.

The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An exhaust gas recirculation system of an internal combustion engine where a cylinder head having a plurality of intake ports and a plurality of exhaust ports is coupled to a cylinder block, and a portion of an exhaust gas exhausted from the exhaust port is flowed into the intake port through one control valve, comprising:

a recirculation gas gallery integrally formed at the cylinder head and communicated with each intake port and receiving the exhaust only from the one control valve;

a plurality of recirculation gas extracting units formed in the cylinder head between the exhaust ports and the one control valve and respectively communicated with each exhaust port, the recirculation gas extracting units being continuously communicated with each other;

the one control valve adapted to control an amount of the portion of the exhaust gas so as to control a supply amount of the exhaust gas to the recirculation gas gallery;

an inflow pipe connected to one of the plurality of the recirculation gas extracting units and to the one control valve; and a supplying pipe provided with an end communicated with the control valve and the other end thereof communicated with the recirculation gas gallery.

2. The system of claim 1, wherein the at least a recirculation gas extracting unit is integrally formed in the cylinder head.

3. The system of claim 1, wherein the control valve assembly is integrally formed in the cylinder head.

4. The system of claim 1, wherein the at least a recirculation gas extracting unit is configured to communicate with the exhaust port.

5. The system of claim 1, wherein the control valve assembly comprises:

an inflow pipe formed such that the portion of the exhaust gas can be flowed into the control valve therethrough; and a supplying pipe provided with one end communicated with the control valve and the other end thereof communicated with the recirculation gas gallery, wherein the control valve controls an amount of the portion of the exhaust gas so as to supply the amount of the exhaust gas to the recirculation gas gallery.

6. The system of claim 5, wherein the inflow pipe is connected to one of the at least a recirculation gas extracting unit which is disposed closest to the control valve assembly.

7. The system of claim 1, wherein the inflow pipe is connected to a recirculation gas extracting unit closest to the control valve.

* * * * *